US005084932A

United States Patent [19]

Zanchi

[11] Patent Number: 5,084,932

[45] Date of Patent: Feb. 4, 1992

[54] DRIP COLLAR FOR A PAINT BRUSH

[76] Inventor: Dale E. Zanchi, 1557 McCay Ave., Louisville, Ky. 40213

[21] Appl. No.: 602,810

[22] Filed: Oct. 24, 1990

[51] Int. Cl.[5] ..... A46B 17/08

[52] U.S. Cl. ..... 15/248 R; 15/168

[58] Field of Search ..... 15/246, 248 R, 168, 15/169

[56] References Cited

U.S. PATENT DOCUMENTS

| | | | |
|---|---|---|---|
| 209,279 | 10/1878 | Marsden | 15/168 |
| 305,545 | 9/1884 | Sutton | 15/248 R |
| 1,769,233 | 7/1930 | Pistorius | 15/248 R |
| 1,864,059 | 6/1932 | Frenkel | 15/248 R |

FOREIGN PATENT DOCUMENTS

| | | | |
|---|---|---|---|
| 3758 | of 1878 | United Kingdom | 15/168 |
| 2181 | of 1898 | United Kingdom | 15/168 |

*Primary Examiner*—Edward L. Roberts
*Attorney, Agent, or Firm*—Jon C. Winger

[57] ABSTRACT

A removable drip collar for a paint brush to prevent paint from running back over the handle of the paint brush and also to prevent paint from flowing to the proximal ends of the brush bristles. The collar includes an elastomeric sleeve which tightly fits around the brush handle and extends over a portion of the brush bristles to tightly compress the proximal ends of the bristles together to create a liquid-tight seal between adjacent bristles and between the bristles and the sleeve.

3 Claims, 1 Drawing Sheet

DRIP COLLAR FOR A PAINT BRUSH

BACKGROUND OF THE INVENTION

The present invention is directed to drip shields for collars for paint brushes, and more particularly to a drip collar removably attachable to a paint brush to create a liquid-tight seal around the brush handle and to radially compress the bristles adjacent the handle to create a liquid-tight seal between adjacent bristles and between the bristles and the collar.

Various drip shields for brushes are known to me. Examples of such prior-known shields are shown in the following patents.

U.S. Pat. No. 1,009,583 issued on Nov. 21, 1911 to Rowley and Albright discloses a frusto-conically-shaped drip shield fabricated of rubber for a shaving brush. The periphery of the smaller opening of the frusto-conical shield has a flange which fits around the brush handle in a circumferential groove in the handle and the shield projects therefrom to a point above the juncture of the bristles and the handle. The shield can be moved down onto the bristles of the brush, and due to its rubber construction, the shield can be grasped around its periphery to cause flange of the smaller opening against the bristles to provide a pressure on the bristles to squeeze the soap and water from the bristles as the shield is moved downwardly over the bristles.

U.S. Pat. No. 1,161,378 issued on Nov. 23, 1915 to C. R. Day discloses a metal drip cap which is attached to a paint brush handle above the brush bristles. The cup is lined with felt to tear tightly against the paint brush ferrule and to allow for the cup to fit different sized brush handles and to also accommodate itself to unevenness of the brush ferrule.

U.S. Pat. No. 1,130,759 issued on Mar. 9, 1915 to Osborn discloses a paint receptacle fitted to a paint brush handle above the bristles for holding or containing a supply of paint which is gradually fed to the bristles of the paint brush. Fingers attached to the receptacle extend over the bristles to control the flow of paint from the receptical to the brush bristles.

U.S. Pat. No. 2,027,771 discloses a paint brush having a metal bridle attached to the wooden handle of a paint brush for securing the bristles to the handle. The metal bridle includes a flared-out portion forming a cup to catch dripping paint. The sides of the bridle are formed with ribs to form indented square-shaped areas to provide for improved grip of the brush by the user's hand while holding the brush.

SUMMARY OF THE INVENTION

One problem in using a paint brush is that the paint will run back over the handle and onto the user's hand.

Another problem in using a paint brush is that the paint flows or migrates to the proximal ends of the brush bristles. Paint in the interstices of the bristles at the proximal ends of the brush bristles is very difficult to clean out of the bristles and will accumulate over use destroying the paint brush.

The present invention provides a removable drip collar for a paint brush which fits tightly around the brush handle creating a liquid-tight seal therebetween.

The present invention also provides a removable drip collar for a paint brush which fits tightly around the brush bristles proximate the proximal ends thereof radially compressing the bristles together creating a liquid-tight seal between adjacent bristles preventing paint from migrating into the interstices of the bristles proximate their proximal ends, and creating a liquid-tight seal between the bristles and the collar.

The present invention also provides a removable drip collar for a paint brush which has a flange preventing paint from flowing back over the brush handle.

The present invention further provides a removable drip collar for a paint brush of the class described which is readily cleanable of paint.

More particularly, the present invention provides a removable drip collar for a paint brush comprising a sleeve of an elastomeric material having a length sufficient to receive the handle of the paint brush adjacent the ends of the brush bristles attached to the handle and extend over a portion of the length of the bristles, and sleeve being circumferential sized to radially tightly grip the perimeter of the handle creating a liquid-tight seal therebetween, and also being circumferentially sized to compress the proximal ends of the bristles proximate the handle tightly together in a radial direction of the sleeve to create a liquid-tight seal between adjacent bristles and between the bristles and the sleeve.

BRIEF DESCRIPTION OF THE DRAWINGS

A better understanding of the invention will be had upon reference to the following specification in conjunction with the accompanying drawings wherein.

DETAILED DESCRIPTION OF THE PREFERRED EMBODIMENT

Figure 1:
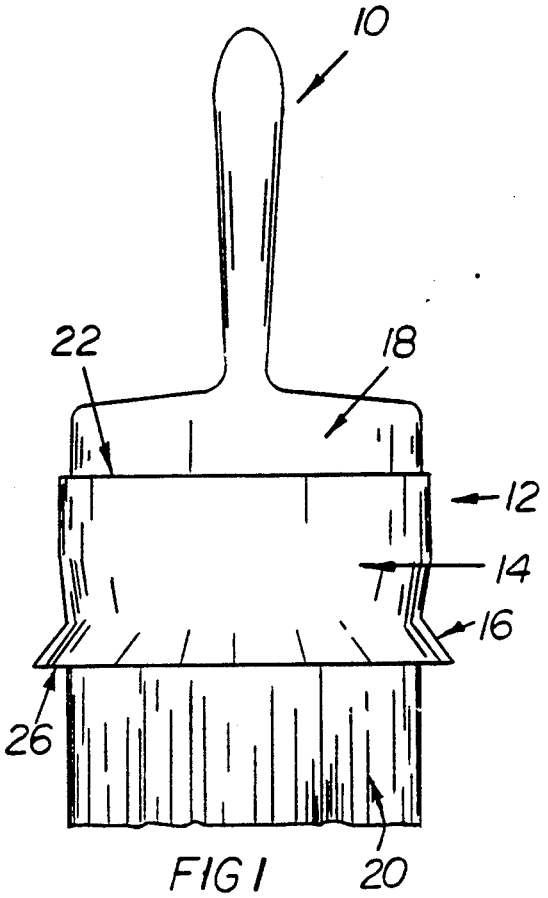
FIG. 1 is a front view of a paint brush with the collar of the present invention installed thereon.
Figure 2:
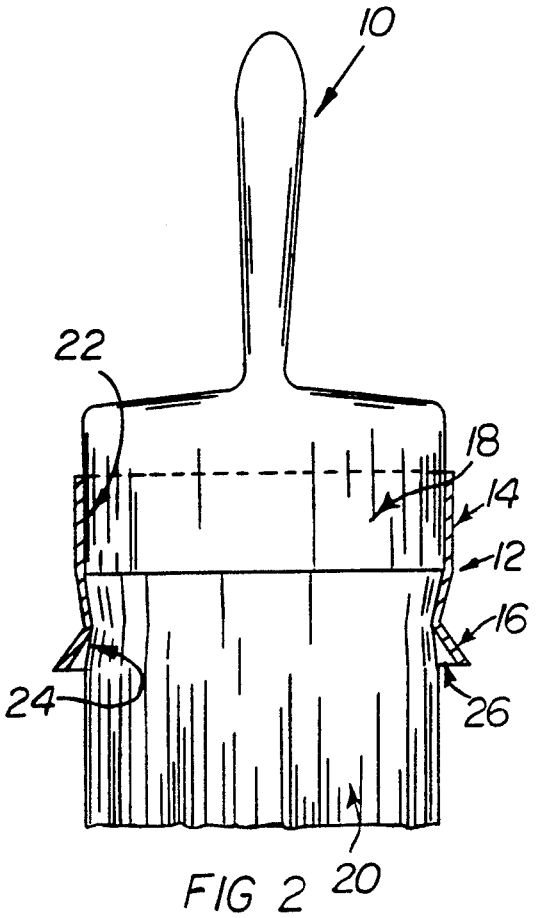
FIG. 2 is a front view of the paint brush of FIG. 1 showing the collar of the invention in cross-section; and, FIG. 3 is a side view of the paint brush of FIG. 1 showing the collar of the invention in cross-section.
Figure 3:
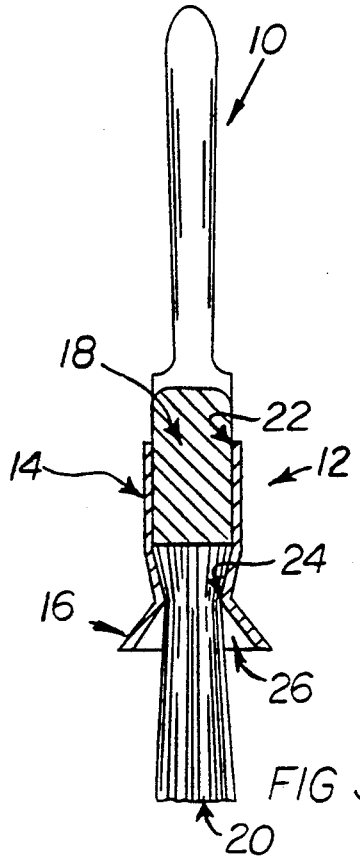
Figure 4:
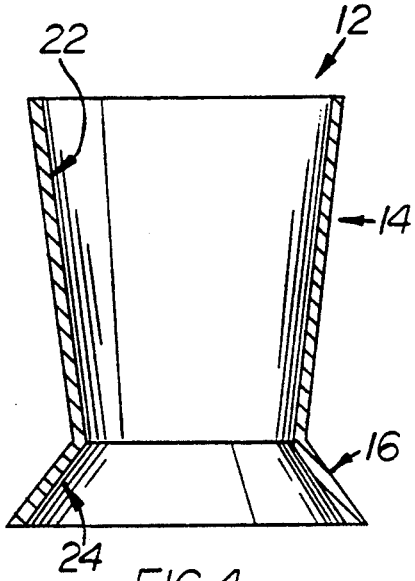
FIG. 4 is a cross-sectional front view of the drip collar in a relaxed condition removed from the brush.
Figure 5:
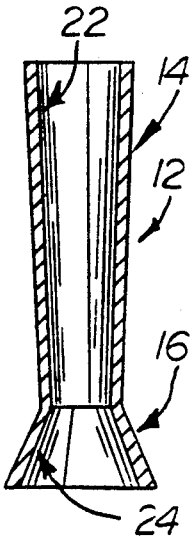
FIG. 5 is a cross-sectional side view of the drip collar removed from the brush.

With reference to FIGS. 1, 2 and 3, there is shown a conventional paint brush, generally denoted as the numeral 10, having a drip collar, generally denoted as the numeral 12, of the present invention removably installed thereon.

The drip collar 10 is fabricated of an elastomeric material such as, for example, vinyl or neoprene, which will not be destroyed by paint and from which paint is easily removed by water or paint remover.

With reference to FIGS. 1-5, the removable drip collar 12 comprises a sleeve portion 14 and a circumferential flange 16 unitary with the sleeve portion 14 at one end of the sleeve portion 14.

The sleeve portion 14 has a length sufficient to receive a portion of the paint brush handle 18 adjacent the proximal end of the brush bristles 20 attached to the handle 18 and to extend over a portion of the length of the brush bristles 20. The sleeve 14 is circumferentially sized to radially grip the perimeter of the brush handle 18 to hold the drip collar 12 in place on the paint brush 10 and to create a liquid-tight seal between the sleeve 14 and brush handle 18 preventing paint from migrating into the interface between the brush handle 18 and sleeve 14. Toward this objective, the sleeve 14 can be slightly smaller in circumference than the brush handle 18. The sleeve 14 is also circumferentially sized to compress the brush bristles 20 tightly together near their proximal ends in a radial direction of the sleeve 14 to create a liquid-tight seal between adjacent bristles 20 to prevent paint from migrating into the interstices of the bristles 20 near their proximal ends whereat they are attached to the brush handle 18. In addition, a liquid-tight seal is created between the sleeve 14 and brush bristles 20 to prevent paint from migrating into the interface between the sleeve 14 and brush bristles 20. Toward this objective, the sleeve 14 is tapered from its top open end 22 toward its bottom open end 24. A taper of from about 1° to about 3° relate to the longitudinal axis of the sleeve 14 has been found to work well.

The drip collar 12 further includes a circumferential flange 16 at the bottom end 24 of the sleeve 14 which extends over the brush bristles 20. The flange 16 projects from the sleeve 14 in a generally radially outwardly projecting direction of the sleeve 14. Preferably, the flange 16 projects outwardly at an acute angle to the longitudinal axis of the sleeve 14 so that when the drip collar 12 is installed on the paint brush 10, the circumferential flange 16 cooperates with the perimeter of the brush bristles 20 to define a circumferential trough 26 for catching and collecting paint that may run back over the brush bristles 20, and the brush handle 18 as the paint brush 10 is being used to apply paint to an elevated surface.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

I claim:

1. A removable drip collar for a paint brush comprising:

a sleeve of an elastomeric material having an open top end and an open bottom end with a length between the open top end and open bottom end sufficient to receive the handle of the paint brush adjacent the ends of the brush bristles attached to the handle and extend over a length of the bristles, the open top end of the sleeve being circumferentially sized to radially tightly grip the perimeter of the handle creating a liquid-tight seal therebetween, and also being circumferentially sized at its open bottom end to compress the bristles tightly together near their proximal ends in a radial direction of the sleeve to create a liquid-tight seal between adjacent bristles to prevent paint from immigrating into the interstices of the bristles near their proximal ends and to create a liquid-tight seal between the bristles and the open bottom end of the sleeve to prevent paint from migrating into the interface between the bottom end of the sleeve and the brush bristles; and, a circumferential flange unitary with the sleeve at the open bottom end of the sleeve to extend over the brush bristles and projecting in a radial outward direction of the sleeve at an acute angle to the longitudinal axis of the sleeve and cooperating with the perimeter of the brush bristles to define a circumferential trough at the bottom end of the sleeve between the brush bristles and the flange when the drip collar is installed on a paint brush.

2. The removable drip collar of claim 1, wherein the sleeve tapers from the open top end toward the open bottom end thereof to extend over the brush bristles.

3. The removable drip collar of claim 2, wherein the sleeve taper is from about 1° to about 3° relative to the longitudinal axis of the sleeve.

* * * * *